US011852110B2

(12) United States Patent
Buseki et al.

(10) Patent No.: US 11,852,110 B2
(45) Date of Patent: Dec. 26, 2023

(54) EVAPORATED FUEL TREATMENT APPARATUS

(71) Applicant: AISAN KOGYO KABUSHIKI KAISHA, Obu (JP)

(72) Inventors: Naohito Buseki, Obu (JP); Mariko Kawase, Obu (JP)

(73) Assignee: AISAN KOGYO KABUSHIKI KAISHA, Obu (JP)

( * ) Notice: Subject to any disclaimer, the term of this patent is extended or adjusted under 35 U.S.C. 154(b) by 274 days.

(21) Appl. No.: 17/606,935

(22) PCT Filed: Jun. 9, 2020

(86) PCT No.: PCT/JP2020/022685
§ 371 (c)(1),
(2) Date: Oct. 27, 2021

(87) PCT Pub. No.: WO2021/002160
PCT Pub. Date: Jan. 7, 2021

(65) Prior Publication Data

US 2022/0205417 A1 Jun. 30, 2022

(30) Foreign Application Priority Data

Jul. 1, 2019 (JP) ..... 2019-122667

(51) Int. Cl.
*F02M 25/08* (2006.01)
*F02M 37/00* (2006.01)

(52) U.S. Cl.
CPC ..... *F02M 37/0017* (2013.01); *F02M 25/08* (2013.01); *F02M 37/0023* (2013.01); *F02M 37/0047* (2013.01)

(58) Field of Classification Search
CPC ..... F02M 37/00; F02M 37/0017; F02M 37/0023; F02M 37/0047; F02M 37/0076;
(Continued)

(56) References Cited

U.S. PATENT DOCUMENTS 5,944,076 A * 8/1999 Palvoelgyi ..... B60K 15/03519 123/519
6,892,712 B2 * 5/2005 Miwa ..... F02M 25/0809 123/198 D
(Continued)

FOREIGN PATENT DOCUMENTS

EP 3 135 893 A1 3/2017
JP H05-126004 A 5/1993
(Continued)

OTHER PUBLICATIONS

Aug. 18, 2020 International Search Report issued in International Patent Application No. PCT/JP2020/022685.
(Continued)

*Primary Examiner* — Matthew W Jellett
(74) *Attorney, Agent, or Firm* — Oliff PLC

(57) ABSTRACT

An evaporated fuel treatment apparatus includes an electrically-operated valve disposed between a full tank control valve and an atmosphere open port and a control unit that controls the electrically-operated valve, and the control unit performs valve-closing control that fully closes the electrically-operated valve when a valve-closing condition is satisfied after the start of fuel supply, in which a value measured by a fuel volume measurement unit is equal to or greater than a first predetermined value determined in advance and a value detected by a pressure sensor is equal to or greater than a second predetermined value determined in advance.

10 Claims, 10 Drawing Sheets

(58) Field of Classification Search
CPC .. F02M 25/08; F02M 25/0836; F02M 25/089; B60K 15/03; B60K 2015/0319; B60K 2015/03368; Y10T 137/7761; Y10T 137/86324; Y10T 137/86332; Y10T 137/3099
See application file for complete search history.

(56) References Cited

U.S. PATENT DOCUMENTS

| | | | | |
|---|---|---|---|---|
| 6,988,396 | B2 * | 1/2006 | Matsubara | F02M 25/089 73/114.38 |
| 9,638,142 | B2 * | 5/2017 | Tagawa | F02M 25/0809 |
| 9,797,346 | B2 * | 10/2017 | Takakura | B60K 15/03519 |
| 10,434,871 | B2 * | 10/2019 | Ogiwara | F02M 25/0809 |
| 2006/0086343 | A1 * | 4/2006 | Suzuki | F02M 25/089 73/114.38 |
| 2011/0186149 | A1 | 8/2011 | Tagami et al. | |
| 2013/0075394 | A1 | 3/2013 | Suzuki | |
| 2014/0116401 | A1 * | 5/2014 | Horiba | F02M 25/0809 123/520 |
| 2016/0031315 | A1 | 2/2016 | Suzuki | |
| 2018/0154767 | A1 | 6/2018 | Ogiwara et al. | |

FOREIGN PATENT DOCUMENTS

| | | | |
|---|---|---|---|
| JP | 2004-156497 | A | 6/2004 |
| JP | 2011-178379 | A | 9/2011 |
| JP | 5786788 | B2 | 9/2015 |
| JP | 2017-044113 | A | 3/2017 |
| JP | 2018-091255 | A | 6/2018 |
| JP | 2019-085875 | A | 6/2019 |

OTHER PUBLICATIONS

Dec. 28, 2021 International Preliminary Report on Patentability issued in International Patent Application No. PCT/JP2020/022685.

* cited by examiner

EVAPORATED FUEL TREATMENT APPARATUS

CROSS-REFERENCE TO RELATED APPLICATIONS

This is a US national phase application based on the PCT International Patent Application No. PCT/JP2020/022685 filed on Jun. 9, 2020, and claiming the priority to Japanese Patent Application No. 2019-122667 filed on Jul. 1, 2019, the entire contents of which are incorporated by reference herein.

TECHNICAL FIELD

The present disclosure relates to an evaporated fuel treatment apparatus for treating evaporated fuel generated in a fuel tank of an internal combustion engine mounted on a vehicle.

BACKGROUND ART

An evaporated fuel treatment apparatus is utilized in order to prevent dispersion of evaporated fuel generated in a fuel tank into the atmosphere. In this evaporated fuel treatment apparatus, evaporated fuel in the fuel tank is introduced into a canister containing an adsorbent, and temporarily adsorbed on the adsorbent. When a condition to perform purging is satisfied based on an operating condition of an internal combustion engine, the purging is performed to purge the evaporated fuel adsorbed on the adsorbent into an intake passage of the internal combustion engine through a purge passage.

Some of such evaporated fuel treatment apparatus include a mechanical full-tank control valve is placed at a lower end of a vapor passage (an end located in the fuel tank) (see Patent Document 1). This full-tank control valve is configured to open when the fuel level in the fuel tank is lower than the full-tank liquid level. When the fuel level rises to the full-tank liquid level, a float of the full-tank control valve moves up and thus the full-tank control valve is closed. When the full-tank control valve is closed, consequently, the internal pressure of the fuel tank increases and the fuel is filled up to the vicinity of a fuel supply port of a fuel supply pipe. Therefore, an automatic stop function of the refueling gun is operated to stop the fuel supply through the refueling gun, thereby preventing overflow of fuel from the fuel supply pipe.

RELATED ART DOCUMENTS

Patent Documents

Patent Document 1: Japanese unexamined patent application publication No. 2011-178379 (JP2011-178379A)

SUMMARY OF INVENTION

Problems to be Solved by the Invention

However, in the evaporated fuel treatment apparatus described above, when a certain time (10 seconds to several ten seconds) elapses after the full-tank control valve is closed, the full-tank control valve is opened and hence the fuel level in the fuel supply pipe lowers down, so that additional fuel supply is enabled. As a result, a user who wants to supply fuel to a full capacity of the fuel tank performs additional fuel supply two times or more. This may oversupply the fuel beyond the capacity of the fuel tank. If the fuel is additionally supplied beyond the capacity of the fuel tank, the fuel may flow into the vapor passage and further infiltrate in the canister, thus deteriorating the canister. Such a situation must be avoided.

The present disclosure has been made to address the above problems and has a purpose to provide an evaporated fuel treatment apparatus capable of reliably preventing additional fuel supply that exceeds the capacity of a fuel tank.

Means of Solving the Problems

To achieve the above-mentioned purpose, one aspect of the present disclosure provides an evaporated fuel treatment apparatus comprising: a vapor passage connecting to a fuel tank; a canister for storing an evaporated fuel fed from the fuel tank through the vapor passage; an atmosphere passage connecting the canister to an atmosphere open port; a full-tank control valve placed at an end of the vapor passage on a fuel tank side; a pressure sensor for detecting an internal pressure of the fuel tank; a fuel volume measurement unit for measuring a fuel volume in the fuel tank; and an operation unit to be operated for performing fuel supply, wherein the evaporated fuel treatment apparatus further comprises: an electrically-operated valve placed between the full-tank control valve and the atmosphere open port; and a control unit for controlling the electrically-operated valve, and the control unit is configured to perform valve-closing control to fully close the electrically-operated valve when a valve-closing condition that a measured value by the fuel volume measurement unit is equal to or larger than a first predetermined value previously determined and a detected value by the pressure sensor is equal to or larger than a second predetermined value previously determined is satisfied after start of the fuel supply.

In the foregoing evaporated fuel treatment apparatus, the electrically-operated valve is placed between the full-tank control valve and the atmosphere open port, that is, in the vapor passage or the atmosphere passage. After the start of fuel supply, when the valve-closing condition of the electrically-operated valve is satisfied, the control unit executes the valve-closing control. Specifically, after the measured value by the fuel volume measurement unit becomes equal to or larger than the first predetermined value that is determined in advance, when the pressure in the fuel tank increases and the detected value by the pressure sensor becomes the second predetermined value or more, the electrically-operated valve is fully closed. Herein, until the measured value by the fuel volume measurement unit becomes the first predetermined value determined in advance, the electrically-operated valve is not fully closed. Thus, even if initial stop occurs that the internal pressure of the fuel tank sharply rises at the initial stage of fuel supply, the electrically-operated valve is not fully closed.

Subsequently, when the amount of supplied fuel increases and the full-tank control valve is closed, the fuel level in the fuel supply pipe rises and thus fuel supply through a refueling gun is stopped by an automatic stop function of the refueling gun. At that time, the internal pressure of the fuel tank temporarily rises above the second predetermined value, so that the electrically-operated valve is closed. Accordingly, the fuel level in the fuel supply pipe is maintained, disabling additional fuel supply. This makes it possible to reliably prevent additional fuel supply that exceeds the capacity of the fuel tank. The operation unit may include for example a lid switch, a lid door, and others.

In the foregoing evaporated fuel treatment apparatus, while the electrically-operated valve is closed before fuel supply, when the control unit detects the operation unit is operated, the control unit may open the electrically-operated valve.

When the electrically-operated valve is closed as in a sealed tank system, fuel supply is disabled. In the case where the electrically-operated valve is in a closed state before fuel supply, therefore, when it is detected that the operation unit is operated (e.g., when a lid switch is operated), that is, when fuel supply is to be performed, the control unit opens the electrically-operated valve. This can perform smooth fuel supply and reliably prevent additional fuel supply that exceeds the capacity of the fuel tank. Further, a vehicle incorporating a sealed tank system includes the electrically-operated valve and thus can achieve the above-mentioned effect without adding a new component.

In the foregoing evaporated fuel treatment apparatus, preferably, even when the valve-closing condition is satisfied, the control unit disables the valve-closing control when a number of times the valve-closing condition is satisfied is less than a predetermined set number of times, and the control unit performs the valve-closing control when the number of times the valve-closing condition is satisfied reaches the predetermined set number of times.

This configuration can set the number of times the additional fuel supply is permitted (the allowable number of additional fuel supplies) and therefore can supply fuel to a full capacity of the fuel tank while reliably preventing additional fuel supply that exceeds the capacity of the fuel tank. The allowable number of times of additional fuel supplies may be set at an optimum number of times for each type of vehicle based on the fuel supply amount with which the full-tank control valve is closed and the capacity of the fuel supply pipe.

In the foregoing evaporated fuel treatment apparatus, furthermore, preferably, when the electrically-operated valve is in an open state before the fuel supply and then the electrically-operated valve is closed after end of the fuel supply, the control unit opens the electrically-operated valve when the control unit detects that a lid door is closed.

This configuration can reliably prevent additional fuel supply that exceeds the capacity of the fuel tank and enables the canister to appropriately treat the evaporated fuel after the end of fuel supply. When it is detected that the lid door is closed after the end of fuel supply but the additional fuel supply is not performed by the allowable number of times, the electrically-operated valve is maintained in a valve-open state.

In the foregoing evaporated fuel treatment apparatus, preferably, before the electrically-operated valve is closed, when the measured value by the fuel volume measurement unit is equal to or larger than a third predetermined value that is smaller than the first predetermined value and the detected value by the pressure sensor is smaller than the second predetermined value, the control unit performs a preliminary valve-closing control to adjust a valve opening degree of the electrically-operated valve to 10% to 50%.

With this configuration, before the full-tank control valve is closed, the preliminary valve-closing control is performed to adjust the valve opening degree of the electrically-operated valve to 10 to 50%. When the full-tank control valve is caused to close, therefore, the electrically-operated valve can be reliably fully closed without causing a response delay. Thus, this configuration can more reliably prevent the additional fuel supply that exceeds the capacity of the fuel tank.

Effects of the Invention

According to the present disclosure, an evaporated fuel treatment apparatus can be provided capable of reliably preventing additional fuel supply that exceeds the capacity of a fuel tank.

MODE FOR CARRYING OUT THE INVENTION

First Embodiment

A detailed description of an evaporated fuel treatment apparatus which is an embodiment of this disclosure will now be given referring to the accompanying drawings. The first embodiment describes an example in which an evaporated fuel treatment apparatus adopting a sealed tank system is applied to an engine system of a vehicle.

<System Overall Configuration>

Figure 1:
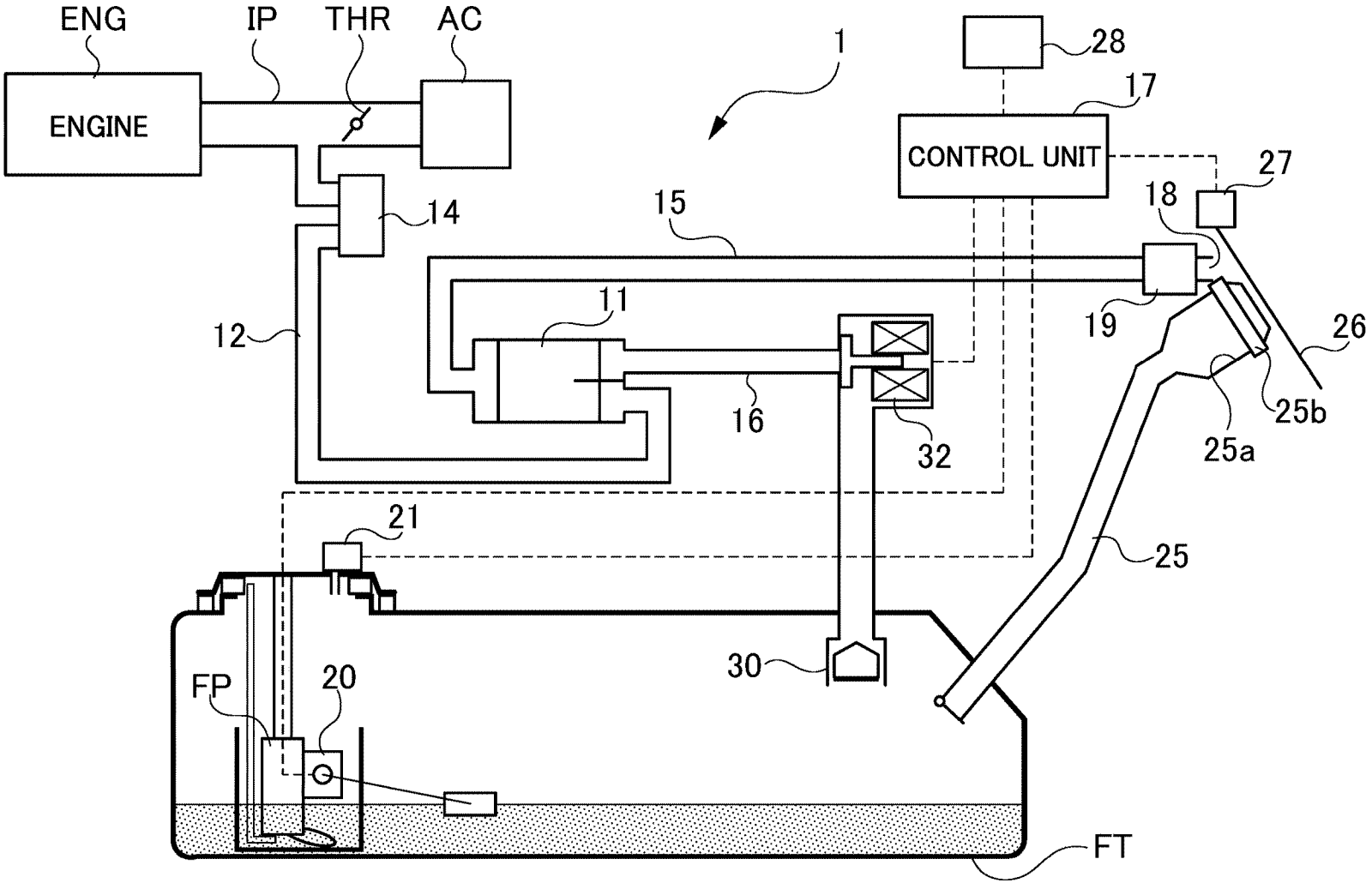
FIG. 1 is a schematic diagram showing an overall configuration of an engine system including an evaporated fuel treatment apparatus in a first embodiment.

The engine system in which an evaporated fuel treatment apparatus 1 of the present embodiment is applied will be mounted on a vehicle such as a car. In this apparatus 1, as shown in FIG. 1, an engine ENG is connected to an intake passage IP for supplying air (intake air, suction air) to the engine ENG. In the intake passage IP, a throttle THR (a throttle valve) is provided to open and close the intake passage IP to thereby regulate the amount of air (the intake air amount) flowing in the engine ENG. In the intake passage IP, upstream of the throttle THR, i.e., on an upstream side in a flowing direction of the intake air, an air cleaner AC is provided to remove foreign substances from the air flowing in the intake passage IP. Thus, in the intake passage IP, air passes through the air cleaner AC and is sucked toward the engine ENG.

The evaporated fuel treatment apparatus 1 of this embodiment is configured to supply the evaporated fuel generated in the fuel tank FT in such an engine system to the engine ENG through the intake passage IP, so that the evaporated fuel is treated in the engine ENG. The evaporated fuel treatment apparatus 1 includes a fuel tank FT, a canister 11, a purge passage 12, a purge control valve 14, an atmosphere passage 15, a vapor passage 16, a control unit 17, and an atmosphere open port 18, and others.

The fuel tank FT is configured to store fuel to be supplied to the engine ENG. The fuel tank FT is internally provided with a fuel pump FP to supply the fuel in the fuel tank FT to the engine ENG through a fuel pipe (not shown). The fuel tank FT is provided with a liquid-level sensor 20 for detecting the fuel level to measure the volume of fuel (a remaining amount of fuel) stored in the fuel tank FT, and a pressure sensor 21 for detecting the pressure of the upper space above the fuel level, i.e., a tank internal pressure. The liquid-level sensor 20 is an example of a "fuel volume measurement unit" of the present invention.

The above fuel tank FT is connected with a fuel supply pipe 25 for feeding (supplying) fuel into the tank. The fuel supply pipe 25 is formed, at its upper end, with a fuel supply port 25*a* to which a cap 25*b* is detachably attached. A lid door 26 is provided outside the cap 25*b* attached to the fuel supply port 25*a* so as to cover the cap 25*b* and the fuel supply port 25*a*. Near this lid door 26, a lid opening-closing sensor 27 is provided to detect the open/closed state of the lid door 26.

In the canister 11, an adsorbent such as activated carbon is stored to collect (adsorb and hold) evaporated fuel generated in the fuel tank FT. This canister 11 is connected to the fuel tank FT through the vapor passage 16 and temporarily stores the evaporated fuel flowing in from the fuel tank FT through the vapor passage 16. Further, the canister 11 communicates with the purge passage 12 and the atmosphere passage 15.

The purge passage 12 is connected to the intake passage IP and the canister 11. Accordingly, purge gas (gas containing the evaporated fuel) flowing out of the canister 11 flows through the purge passage 12 and is fed into the intake passage IP. In the example shown in FIG. 1, the purge passage 12 is connected to the intake passage IP at a position downstream of the throttle THR, i.e., on a downstream side in the flowing direction of the intake air relative to the throttle THR.

The purge control valve 14 is provided in the purge passage 12. The purge control valve 14 opens and closes the purge passage 12. When the purge control valve 14 is closed (in a valve closed state), the purge gas in the purge passage 12 is shut off by the purge control valve 14 and does not flow into the intake passage IP. In contrast, when the purge control valve 14 is opened (in a valve open state), the purge gas flows into the intake passage IP.

The atmosphere passage 15 has one end that is open as an atmosphere open port 18 and the other end connected to the canister 11 to communicate the canister 11 with the atmosphere. This atmosphere passage 15 allows the air taken in through the atmosphere open port 18 to flow. Further, a filter 19 is placed near the atmosphere open port 18.

The vapor passage 16 is connected to the fuel tank FT and the canister 11. Accordingly, the evaporated fuel in the fuel tank FT flows into the canister 11 through the vapor passage 16. A full-tank control valve 30 is provided at the lower end of the vapor passage 16, i.e., the end located in the fuel tank FT. The full-tank control valve 30 is of a simple configuration which opens when the fuel level in the fuel tank FT is lower than the upper limit (the full-tank liquid level), and has only a single float so as to be closed when the fuel level rises to the upper limit. The full-tank control valve 30 serves to prevent entry of fuel into the vapor passage 16.

In this embodiment, an electrically-operated valve 32 is placed in the vapor passage 16. This electrically-operated valve 32 is opened and closed by the control unit 17. Specifically, the valve 32 is closed while it is not energized, blocking the communication between the fuel tank FT and the canister 11. In contrast, the valve 32 is opened when energized, allowing the communication between between the fuel tank FT and the canister 11. The evaporated fuel treatment apparatus 1 of the present embodiment adopts a sealed tank system and thus does not need to newly add the electrically-operated valve 32.

The control unit 17 is a part of an ECU (not shown) mounted on a vehicle, and is integrally placed with the other part of the ECU (for example, a part for controlling the engine ENG). The control unit 17 may also be placed separately from the other part of the ECU. The control unit 17 includes a memory, such as a CPU, a ROM, and a RAM. The control unit 17 controls the evaporated fuel treatment apparatus 1 and the engine system in accordance with programs stored in the memory in advance. For example, the control unit 17 controls the purge control valve 14, the fuel pump FP, and others. Furthermore, the control unit 17 obtains output signals from the liquid-level sensor 20, the pressure sensor 21, the lid opening-closing sensor 27, the lid switch 28, and others.

In the present embodiment, the lid switch 28 is connected to the control unit 17. The lid switch 28 is provided in for example a vehicle interior and is operated by a user to open the lid door 26 for a refueling work. When operated by a use, the lid switch 28 outputs a signal to the control unit 17. This lid switch 28 is an example of an "operation unit" of the present invention.

In the evaporated fuel treatment apparatus 1 configured as above, when the purge condition is satisfied during operation of the engine ENG, the control unit 17 opens the purge control valve 14 to execute the purge control. The purge control is a control for introducing purge gas from the canister 11 to the intake passage IP through the purge passage 12.

During execution of the purge control, the engine ENG is supplied with air sucked into the intake passage IP, the fuel supplied from the fuel tank FT and injected through an injector, and the purge gas supplied to the intake passage IP by the purge control. The control unit 17 adjusts the injection time of the injector and the valve opening time of the purge control valve 14 to control the air-fuel ratio (A/F) of the engine ENG to an optimum air-fuel ratio, for example, an ideal air-fuel ratio.

<Details of Control During Fuel Supply>

Next, the control during fuel supply performed by the evaporated fuel treatment apparatus 1 during supply of fuel to a vehicle will be described with reference to FIGS. 2 to 8. In this embodiment, the control unit 17 performs the control during fuel supply based on a control chart shown in FIG. 2. Specifically, the control unit 17 first determines whether the lid switch 28 is turned to "Open" (step S1). At this time, when the lid switch 28 is "Open" (S1: YES), the control unit 17 opens the electrically-operated valve 32 (step S2). Thus, the evaporated fuel in the fuel tank FT is introduced into the canister 11 and recovered thereat. The gas component other than the evaporated fuel is released into the atmosphere through the atmosphere passage 15 and the atmosphere open port 18.

Figure 3:
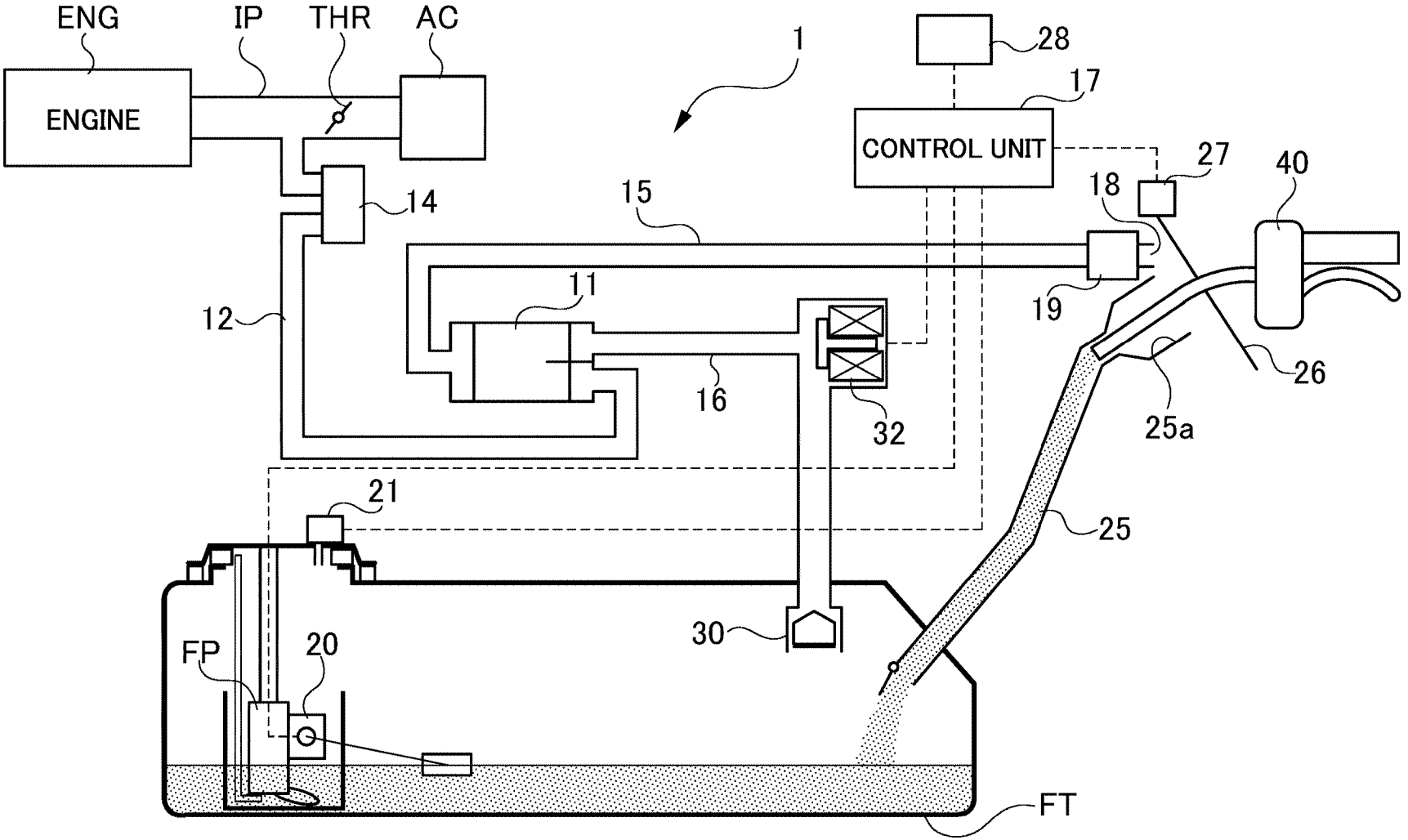
FIG. 3 is a diagram showing a fuel state in a fuel tank and a fuel pipe at the initial stage of fuel supply.

If the tank internal pressure detected by the pressure sensor 21 is close to the atmospheric pressure (step S3: YES), the control unit 17 opens the lid door 26 (step S4). The fuel supply is then started. Specifically, as shown in FIG. 3, the cap 25*b* is removed from the fuel supply port 25*a*, and a refueling gun 40 is inserted into the fuel supply port 25*a*, and the fuel flowing out through the refueling gun 40 is fed into the fuel tank FT through the fuel supply pipe 25.

Figure 4:
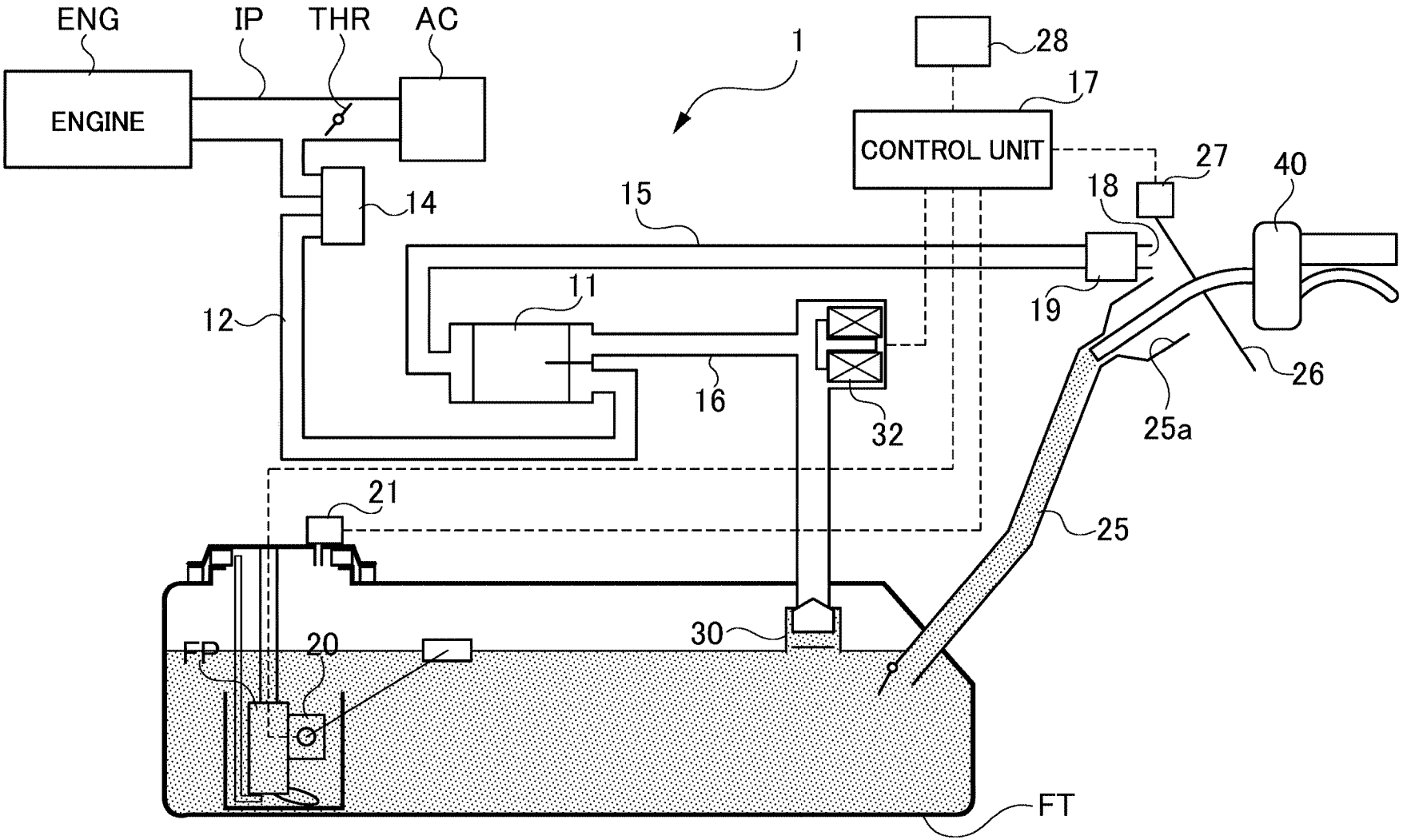
FIG. 4 is a diagram showing the fuel state in the fuel tank and the fuel pipe at first automatic stop.

As the refueling progresses, subsequently, the amount of fuel fed into the fuel tank FT increases and the fuel level in the fuel tank FT gradually rises. As shown in FIG. 4, when the fuel level rises to the full-tank liquid level, the full-tank control valve 30 is closed. Then, the internal pressure of the fuel tank FT increases and the fuel is filled up to the vicinity of the fuel supply port 25*a* of the fuel supply pipe 25. Accordingly, the automatic stop function of the refueling gun 40 is activated to stop the fuel supply from the refueling gun 40 (First-time automatic stop).

During such refueling, the control unit 17 determines whether or not a first valve-closing condition (a liquid level condition) of the electrically-operated valve 32 is satisfied. Specifically, the control unit 17 determines whether or not a detected value by the liquid-level sensor 20 is equal to or larger than a predetermined value H1 (e.g., 80% of the full-tank liquid level) (step S5). When the detected value by the liquid-level sensor 20 is equal to or larger than the predetermined value H1 (S5: YES), the control unit 17 further determines whether or not a second valve-closing condition (a pressure condition) of the electrically-operated valve 32 is satisfied. Specifically, the control unit 17 determines whether or not the number of times the internal pressure of the fuel tank FT increases above a predetermined value P1 (e.g., 3 kPa) reaches the set number of times n (step S6). That is, the control unit 17 determines whether or not the number of times the valve-closing condition of the electrically-operated valve 32 is satisfied (i.e., both the first valve-closing condition and the second valve-closing condition are met) reaches the set number of times n.

The set number of times n (n is a natural number) is determined based on the allowable number of times of additional fuel supplies set for each vehicle type. For example, if the supplied amount of fuel is 98% of the fuel tank capacity at the first automatic stop and the supplied amount of fuel per one additional fuel supply is 1% of the fuel tank capacity, the set number of times n may be determined to be n=3. That is, assuming that the allowable number of times of the additional fuel supply is x, the set number of times n is n=x+1. Since the set number of times n is determined in the above manner, the electrically-operated valve 32 is closed (i.e., fully closed) in the x-th (=n−1) additional fuel supply after the first automatic stop, that is, when the valve-closing condition of the electrically-operated valve 32 is satisfied n times, and hence the fuel can be fed to the fuel tank capacity of 100%.

At that time, if the number of times the tank internal pressure increases is less than n (S6: NO), the control unit 17 determines whether or not the lid door 26 is closed based on a signal from the lid opening-closing sensor 27 (step S7). When the lid door 26 is closed (S7: YES), the control unit 17 closes (i.e., fully closes) the electrically-operated valve 32 (step S8). For instance, this condition corresponds to a situation that, in the case of the set number of times n being n=3, in which the additional fuel supply is permitted up to two times, the additional fuel supply is performed only once and then the fuel supply is terminated, and the lid door 26 is closed. In contrast, if the lid door 26 is not closed (S7: NO), it is considered that additional fuel supply is to be further performed. For example, in the same case as above, it is considered that the second additional fuel supply is to be performed.

Figure 5:
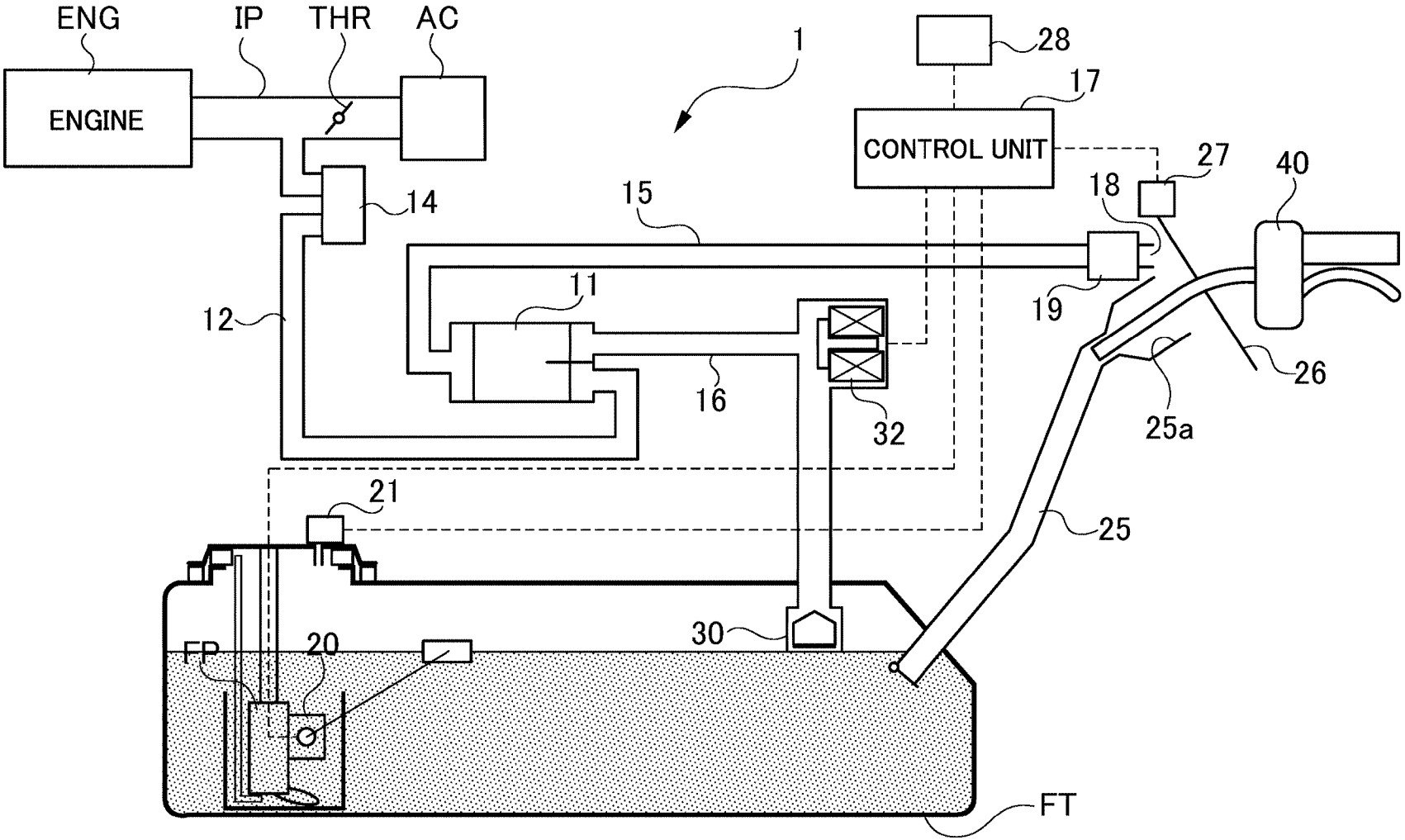
FIG. 5 is a diagram showing the fuel state in the fuel tank and the fuel pipe when a full-tank control valve is opened after the first automatic stop.
Figure 6:
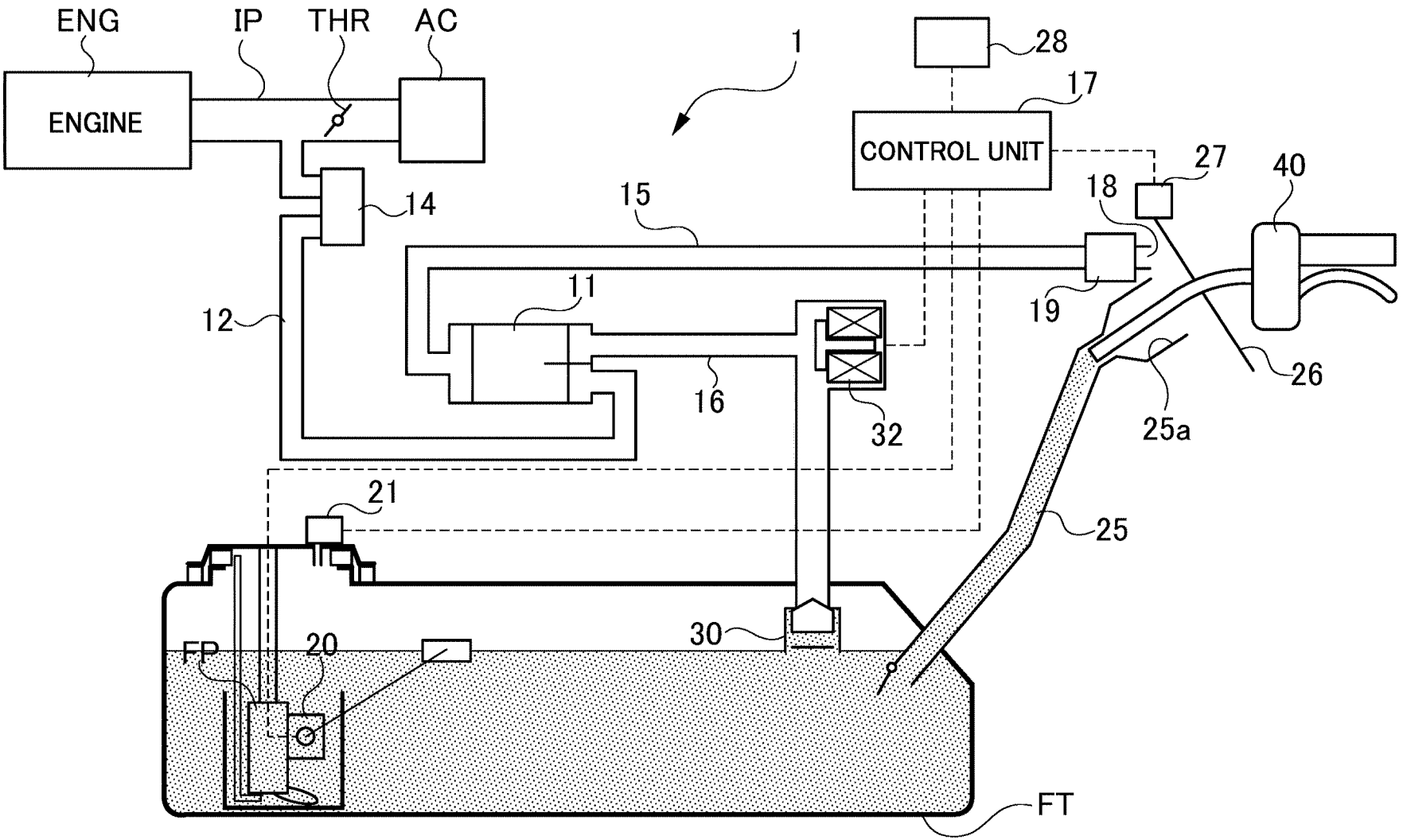
FIG. 6 is a diagram showing the fuel state in the fuel tank and the fuel pipe at second automatic stop.

When additional fuel supply is to be performed, the full-tank control valve 30 is opened as shown in FIG. 5 after a lapse of about 10 seconds from when the full-tank control valve 30 is closed. In this case, the internal pressure of the fuel tank FT decreases, and the fuel level in the fuel supply pipe 25 lowers, so that additional fuel supply is enabled. When the additional fuel supply is then performed, the full-tank control valve 30 is closed again as shown in FIG. 6, and the fuel is filled up again to the vicinity of the fuel supply port 25*a* of the fuel supply pipe 25. Accordingly, the automatic stop function of the refueling gun 40 is activated to stop the fuel supply from the refueling gun 40 (Second-time automatic stop). At this time, the second tank internal pressure increase occurs.

Figure 7:
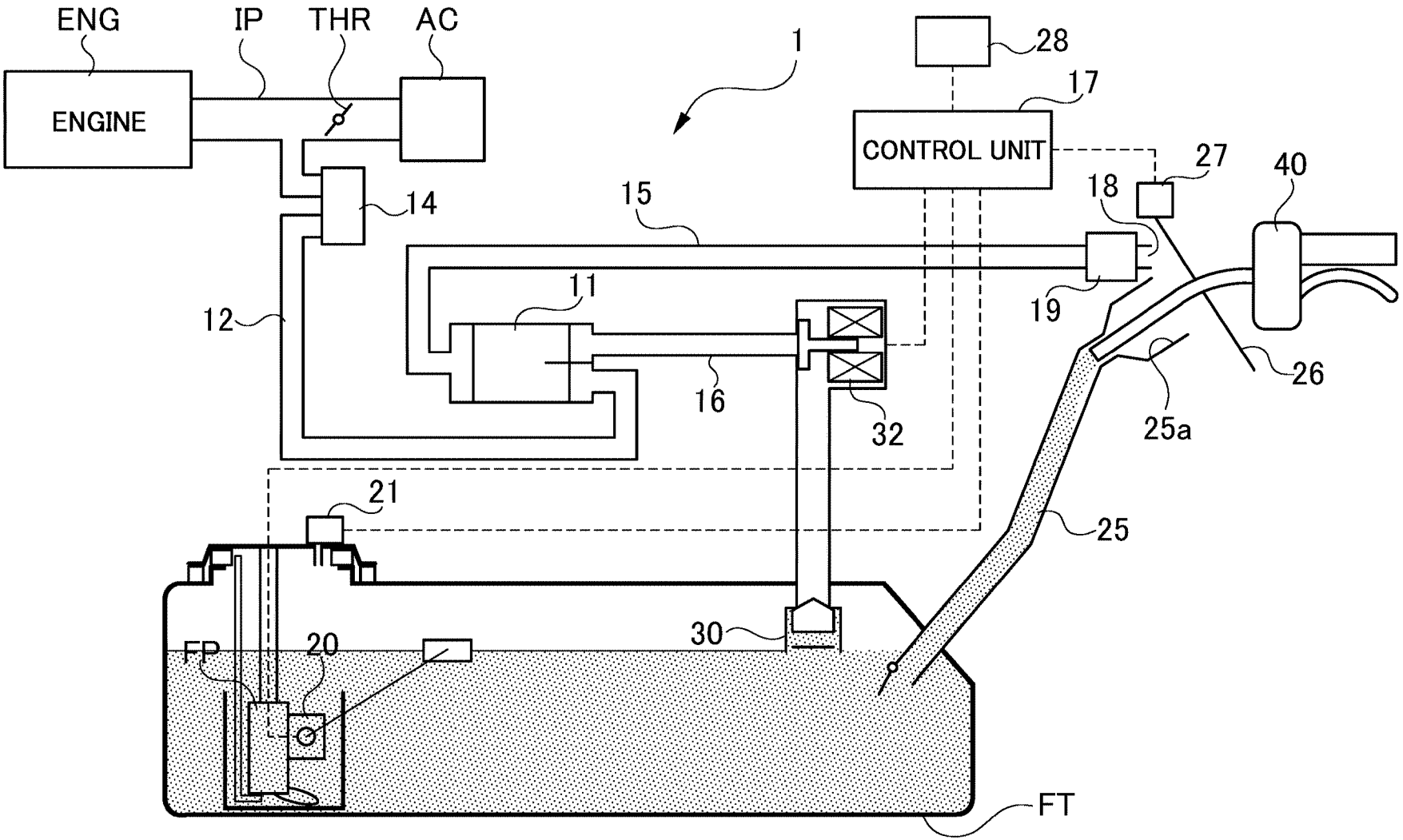
FIG. 7 is a diagram showing the fuel state in the fuel tank and the fuel pipe when a valve-closing condition of an electrically-operated valve is satisfied and thus the electrically-operated valve is closed.

After that, the processes of S7 and S8 are repeated. When the number of times the internal pressure of the fuel tank FT increases reaches the set number of times n (S6: YES), the control unit 17 closes (i.e., fully closes) the electrically-operated valve 32 as shown in FIG. 7 (S8). For instance, this condition corresponds to a situation that, in the case of the set number of times n being n=3, the additional fuel supply was performed twice. Accordingly, the internal pressure of the fuel tank FT does not decrease, so that the fuel level in the fuel supply pipe 25 does not lower. Thus, further additional fuel supply is disabled. In other words, additional fuel supply more than the preset number of times (n−1) is reliably prevented. According to the evaporated fuel treatment apparatus 1 of the present embodiment, as described above, the allowable number of additional fuel supplies can be determined. This apparatus 1 therefore enables fuel supply up to a full capacity of the fuel tank FT (100% of a fuel tank capacity) while reliably preventing additional fuel supply that exceeds the capacity of the fuel tank FT.

Figure 2:
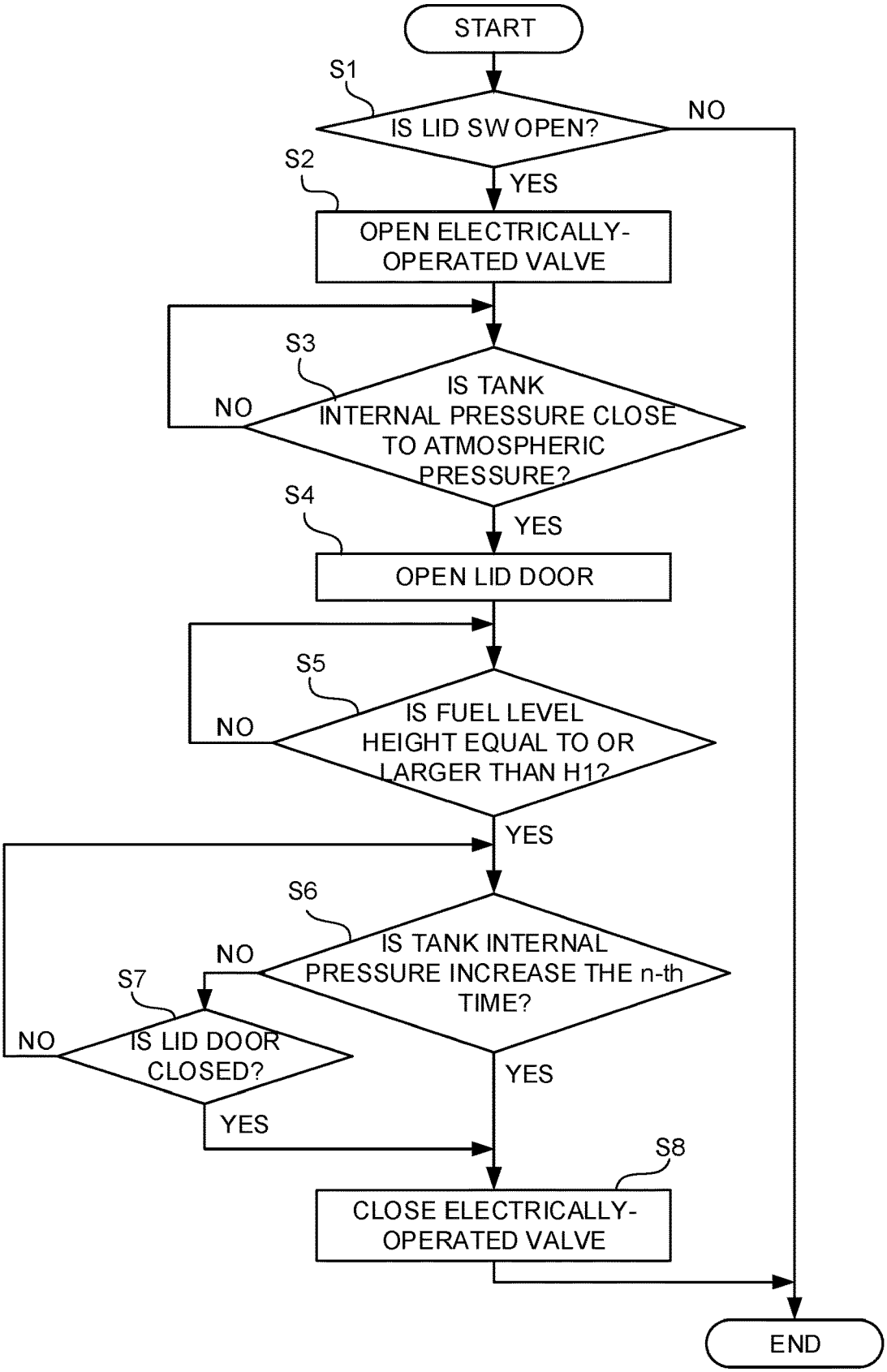
FIG. 2 is a control flowchart showing control during fuel supply in the first embodiment.
Figure 8:
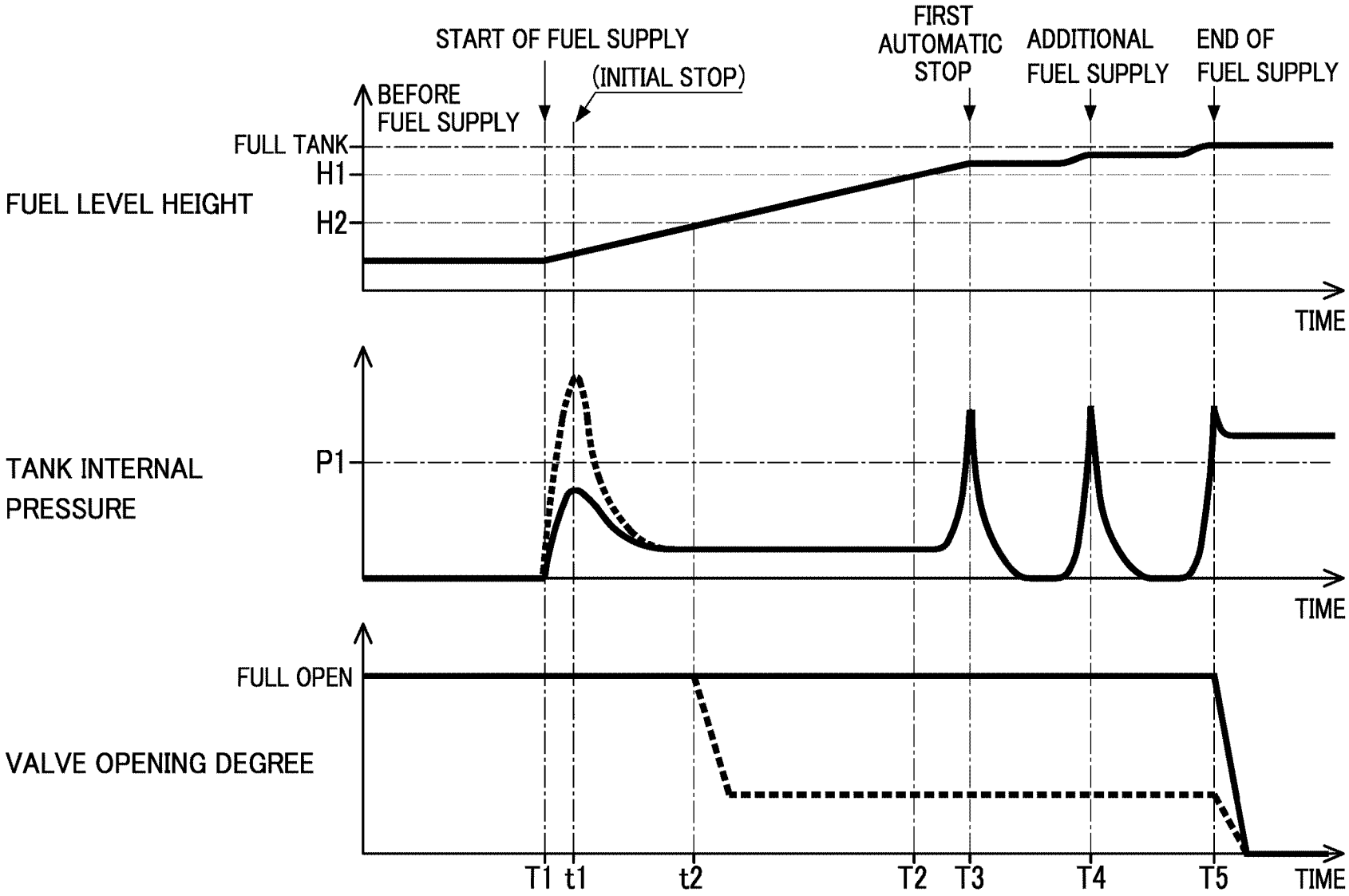
FIG. 8 is a graph showing variations in fuel level height, tank internal pressure, and opening degree of the electrically-operated valve in execution of the control during fuel supply.

Since the control is performed based on the control chart shown in FIG. 2, when the set number of times n is n=3, for example, the height of the fuel level and the internal pressure of the fuel tank FT and the valve-opening degree of the electrically-operated valve 32 vary as plotted in FIG. 8. Specifically, when fuel supply is started at time T1, the internal pressure of the fuel tank FT increases slightly and the fuel level height gradually increases. At time T2, the fuel level height reaches the predetermined value H1 and thus the first valve-closing condition (the liquid level condition) of the electrically-operated valve 32 is satisfied. At subsequent time T3, therefore, the first automatic stop is performed. At that time, the tank internal pressure exceeds the predetermined value P1 and hence the second valve-closing condition (the pressure condition) of the electrically-operated valve 32 is satisfied. However, the number of times the tank internal pressure increases is one, which is less than the set number of times n (=3), so that additional fuel supply is enabled.

When the first additional fuel supply is performed, the second automatic stop is performed at time T4. At this time, the tank internal pressure exceeds the predetermined value P1 again and hence the second valve-closing condition (the pressure condition) of the electrically-operated valve 32 is satisfied. However, the number of times the tank internal pressure increased is two, which is less than the set number of times n (=3), so that further (second) additional fuel supply is performed.

When the second additional fuel supply is then performed, the third automatic stop is performed at time T5. At this time, the tank internal pressure exceeds the predetermined value P1 again, which satisfies the second valve-closing condition (the pressure condition) of the electrically-operated valve 32. Consequently, the number of times the tank internal pressure increases is three, which reaches the set number of times n (=3). Accordingly, while the tank is filled up to the fuel tank capacity of 100%, further fuel supply is no longer enabled, and the fuel supply is terminated. Then, the electrically-operated valve 32 is closed (fully closed) and thus the fuel level in the fuel supply pipe 25 does not lower. This can reliably prevent additional fuel supply that exceeds the capacity of the fuel tank FT.

Herein, if the temperature in the fuel tank FT is high in summer for example, the refueled fuel evaporates instantly. Thus, initial stop may occur that the internal pressure of the fuel tank FT sharply rises at the initial stage of fuel supply (time t1), as shown by a broken line in FIG. 8. When such an initial stop arises, the second valve-closing condition (the pressure condition) of the electrically-operated valve 32 is satisfied, whereas at time t1 the first valve-closing condition (the liquid level condition) of the electrically-operated valve 32 is not satisfied. In the present embodiment, therefore, the electrically-operated valve 32 is not closed even if the initial stop occurs.

Furthermore, prior to closing (fully closing) the electrically-operated valve 32, the control unit 17 may perform a preliminary valve-closing control to adjust the valve opening degree of the electrically-operated valve 32 to 10 to 50% (for example, 40%) at time t2 at which the tank internal pressure is smaller than the predetermined value P1 and the fuel level height becomes a predetermined value H2 (H2<H1) or more (see a broken line of the valve opening degree). The electrically-operated valve 32 may be operated with a stepper motor.

In the preliminary valve-closing control performed as above, the valve opening degree of the electrically-operated valve 32 can be decreased in advance before the full-tank control valve 30 is closed. When the full-tank control valve 30 is closed, accordingly, the electrically-operated valve 32 can be surely fully closed without causing a response delay. This makes it possible to more reliably prevent additional fuel supply that exceeds the capacity of the fuel tank FT.

According to the evaporated fuel treatment apparatus 1 of the present embodiment as described above, when the fuel supply amount is increased and then the full-tank control valve 30 is closed, the fuel level in the fuel supply pipe 25 rises, and fuel supply from the refueling gun 40 is stopped by the automatic stop function of the refueling gun 40. At that time, when the number of times the detected value by the liquid-level sensor 20 is equal to or larger than the predetermined value H1 and further the internal pressure of the fuel tank FT temporarily rises above the predetermined value P1 reaches the set number of times n, the electrically-operated valve 32 is closed. Accordingly, the fuel level in the fuel supply pipe 25 is maintained and hence further additional fuel supply is disabled. This configuration can prevent additional fuel supply that exceeds the capacity of the fuel tank FT. The allowable number of times (n−1) of the additional fuel supply can be determined as above, so that it is possible to supply fuel to the full capacity of the fuel tank FT while reliably preventing extra additional fuel supply that exceeds the capacity of the fuel tank FT.

Second Embodiment

Figure 9:
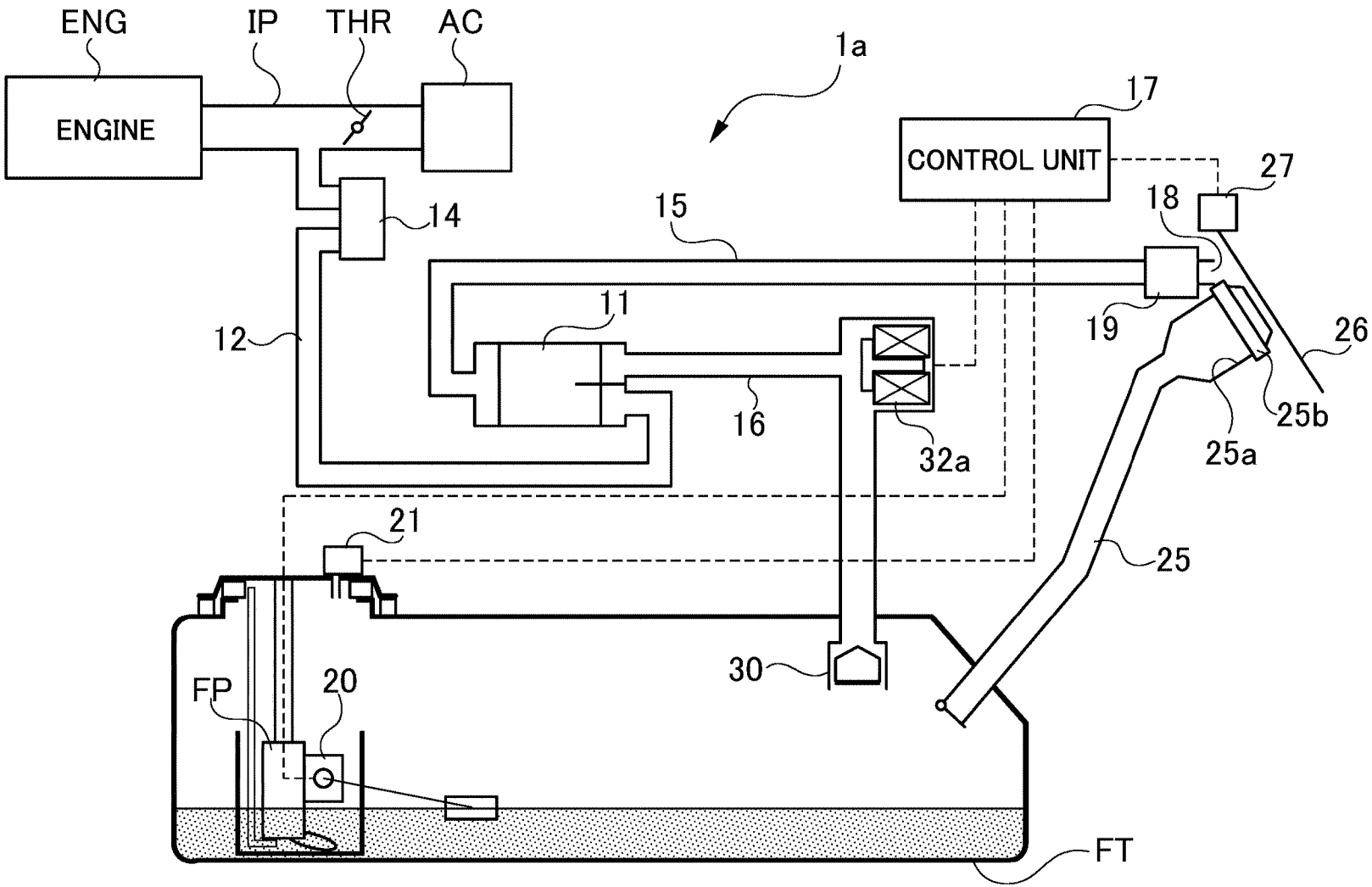
FIG. 9 is a schematic diagram showing an overall configuration of an engine system including an evaporated fuel treatment apparatus in a second embodiment.

A second embodiment will be described below. In the second embodiment, the evaporated fuel treatment apparatus equipped with a general fuel tank FT which is not a sealed tank system will be described referring to FIGS. 9 and 10. As shown in FIG. 9, an evaporated fuel treatment apparatus 1*a* of the second embodiment is basically identical to that of the first embodiment and differs therefrom in that the lid switch 28 is not provided and an electrically-operated valve 32*a* is a normally open valve. Specifically, in the evaporated fuel treatment apparatus 1*a* of this embodiment, the electrically-operated valve 32*a* is opened while it is not energized, allowing the communication between the fuel tank FT and the canister 11, and is closed when energized, blocking the communication between the fuel tank FT and the canister 11.

<Details of Control During Fuel Supply>

Figure 10:
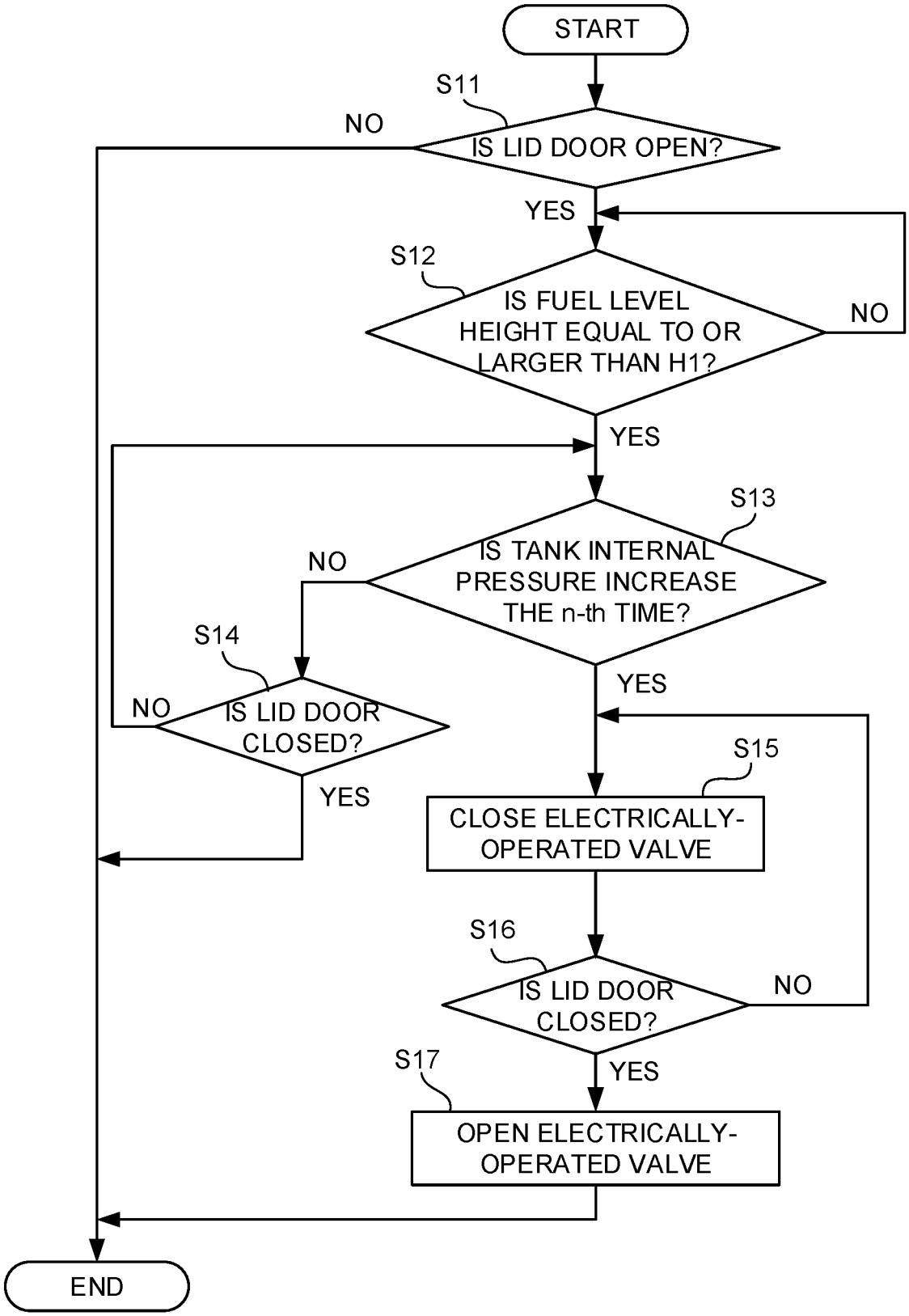
FIG. 10 is a control flowchart of control during fuel supply in the second embodiment.

Next, the control during fuel supply performed by the evaporated fuel treatment apparatus 1*a* during supply of fuel to a vehicle will be described with reference to FIG. 10. In this embodiment, the control unit 17 performs the control during fuel supply based on a control chart shown in FIG. 10. Specifically, the control unit 17 first determines whether or not the lid door 26 is opened (step S11). When the lid door 26 is opened (S11: YES) and fuel supply is started, the control unit 17 determines whether or not the first valve-closing condition (the liquid level condition) of the electrically-operated valve 32*a* is satisfied. To be specific, the control unit 17 determines whether or not the detected value by the liquid-level sensor 20 is equal to or larger than the predetermined value H1 (step S12). The electrically-operated valve 32*a* is in an open state.

When the detected value by the liquid-level sensor 20 is equal to or larger than the predetermined value H1 (S12: YES), the control unit 17 further determines whether or not the second valve-closing condition (the pressure condition) of the electrically-operated valve 32*a* is satisfied. Specifically, the control unit 17 determines whether or not the number of times the internal pressure of the fuel tank FT increases above the predetermined value P1 reaches the set number of times n (step S13). That is, the control unit 17 determines whether or not the number of times the valve-closing condition of the electrically-operated valve 32*a* is satisfied (i.e., both the first valve-closing condition and the second valve-closing condition are met) reaches the set number of times n.

At that time, if the number of times the tank internal pressure increases is less than n (S13: NO), the control unit 17 determines whether or not the lid door 26 is closed based on a signal from the lid opening-closing sensor 27 (step S14). When the lid door 26 is closed (S14: YES), the control unit 17 determines that the fuel supply is finished, and terminates this processing routine. For instance, this condition corresponds to a situation that, in the case of the set number of times n being n=3, in which the additional fuel supply is permitted up to two times, the additional fuel supply is performed only once and then the fuel supply is terminated, and the lid door 26 is closed. In this case, the fuel volume in the fuel tank FT is not 100% and thus the electrically-operated valve 32*a* remains open. The evaporated fuel can be therefore appropriately treated by the canister 11.

In contrast, if the lid door 26 is not closed (S14: NO), it is considered that additional fuel supply is to be further performed. For example, in the above-mentioned case (n=3), it is considered that second additional fuel supply is to be performed. Thus, the operations in steps S13 and S14 are repeated. When the number of times the internal pressure of the fuel tank FT increases reaches the set number of times n (S13: YES), the control unit 17 closes (i.e., fully closes) the electrically-operated valve 32*a* (step S15). For instance, this condition corresponds to a situation that, in the case of the set number of times n being n=3, the additional fuel supply was performed twice. Accordingly, the internal pressure of the fuel tank FT does not decrease, so that the fuel level in the fuel supply pipe 25 does not lower. Thus, further additional fuel supply is disabled. In other words, additional fuel supply exceeding the preset number of times (n−1) is reliably prevented.

After the electrically-operated valve 32*a* is closed, when the lid door 26 is closed, the control unit 17 determines that the fuel supply is finished and then opens the electrically-operated valve 32*a* (step S17). Thus, the evaporated fuel can be appropriately treated by the canister 11 after the end of fuel supply. Even in the evaporated fuel treatment apparatus 1*a* of the present embodiment configured as above, the allowable number of times of the additional fuel supply can be determined. This configuration can supply fuel to the full capacity (a fuel tank capacity of 100%) of the fuel tank FT while reliably preventing additional fuel supply that exceeds the capacity of the fuel tank FT.

According to the evaporated fuel treatment apparatus 1*a* of the present embodiment, as described above, when the fuel supply amount is increased and the full-tank control valve 30 is closed, the fuel level in the fuel supply pipe 25 rises and fuel supply from the refueling gun 40 is stopped by the automatic stop function of the refueling gun 40. At that time, when the number of times the detected value by the liquid-level sensor 20 is equal to or larger than the predetermined value H1 and further the internal pressure of the fuel tank FT temporarily rises above the predetermined value P1 reaches the set number of times n, the electrically-operated valve 32*a* is closed. Accordingly, the fuel level in the fuel supply pipe 25 is maintained and hence further additional fuel supply is disabled. This configuration can prevent additional fuel supply that exceeds the capacity of the fuel tank FT. The allowable number (n−1) of the additional fuel supply can be determined as above, so that it is possible to supply fuel to the full capacity of the fuel tank FT while reliably preventing additional fuel supply that exceeds the capacity of the fuel tank FT.

The foregoing embodiments are mere examples and give no limitation to the present disclosure. The present disclosure may be embodied in other specific forms without departing from the essential characteristics thereof. For example, the foregoing embodiment exemplifies that the electrically-operated valve 32 (32*a*) is placed in the vapor passage 16. As an alternative, the electrically-operated valve 32 (32*a*) may be placed in the atmosphere passage 15. In the foregoing embodiments, the evaporated fuel treatment apparatus of the present disclosure is applied to a naturally-aspirated engine system and, of course, the evaporated fuel treatment apparatus of the present disclosure may also be applied to an engine system equipped with a supercharger.

REFERENCE SIGNS LIST

1 Evaporated fuel treatment apparatus
1*a* Evaporated fuel treatment apparatus
11 Canister
15 Atmosphere passage
16 Vapor passage
17 Control unit
20 Liquid-level sensor
21 Pressure sensor
25 Fuel supply pipe
26 Lid door
27 Lid opening-closing sensor
28 Lid switch
30 Full-tank control valve
32 Electrically-operated valve
32*a* Electrically-operated valve
ENG Engine
FT Fuel tank

The invention claimed is:

1. An evaporated fuel treatment apparatus comprising:
a vapor passage connecting to a fuel tank;
a canister for storing an evaporated fuel fed from the fuel tank through the vapor passage;
an atmosphere passage connecting the canister to an atmosphere open port;
a full-tank control valve placed at an end of the vapor passage on a fuel tank side;
a pressure sensor for detecting an internal pressure of the fuel tank;
a fuel volume measurement unit for measuring a fuel volume in the fuel tank; and
an operation unit to be operated for performing fuel supply,
wherein the evaporated fuel treatment apparatus further comprises:
an electrically-operated valve placed between the full-tank control valve and the atmosphere open port; and
a control unit for controlling the electrically-operated valve, and
the control unit is configured to perform valve-closing control to fully close the electrically-operated valve when a valve-closing condition that a measured value by the fuel volume measurement unit is equal to or larger than a first predetermined value previously determined and a detected value by the pressure sensor is equal to or larger than a second predetermined value previously determined is satisfied after start of the fuel supply.

2. The evaporated fuel treatment apparatus according to claim 1, wherein while the electrically-operated valve is closed before fuel supply, when the control unit detects the operation unit is operated, the control unit opens the electrically-operated valve.

3. The evaporated fuel treatment apparatus according to claim 1, wherein even when the valve-closing condition is satisfied, the control unit disables the valve-closing control when a number of times the valve-closing condition is satisfied is less than a predetermined set number of times, and the control unit performs the valve-closing control when the number of times the valve-closing condition is satisfied reaches the predetermined set number of times.

4. The evaporated fuel treatment apparatus according to claim 1, wherein when the electrically-operated valve is in an open state before the fuel supply and then the electrically-operated valve is closed after end of the fuel supply, the control unit opens the electrically-operated valve when the control unit detects that a lid door is closed.

5. The evaporated fuel treatment apparatus according to claim 1, wherein before the electrically-operated valve is closed, when the measured value by the fuel volume measurement unit is equal to or larger than a third predetermined value that is smaller than the first predetermined value and the detected value by the pressure sensor is smaller than the second predetermined value, the control unit performs a preliminary valve-closing control to adjust a valve opening degree of the electrically-operated valve to 10% to 50%.

6. The evaporated fuel treatment apparatus according to claim 2, wherein wherein even when the valve-closing condition is satisfied, the control unit disables the valve-closing control when a number of times the valve-closing condition is satisfied is less than a predetermined set number of times, and the control unit performs the valve-closing control when the number of times the valve-closing condition is satisfied reaches the predetermined set number of times.

7. The evaporated fuel treatment apparatus according to claim 2, wherein before the electrically-operated valve is closed, when the measured value by the fuel volume measurement unit is equal to or larger than a third predetermined value that is smaller than the first predetermined value and the detected value by the pressure sensor is smaller than the second predetermined value, the control unit performs a preliminary valve-closing control to adjust a valve opening degree of the electrically-operated valve to 10% to 50%.

8. The evaporated fuel treatment apparatus according to claim 3, wherein before the electrically-operated valve is closed, when the measured value by the fuel volume measurement unit is equal to or larger than a third predetermined value that is smaller than the first predetermined value and the detected value by the pressure sensor is smaller than the second predetermined value, the control unit performs a preliminary valve-closing control to adjust a valve opening degree of the electrically-operated valve to 10% to 50%.

9. The evaporated fuel treatment apparatus according to claim 4, wherein before the electrically-operated valve is closed, when the measured value by the fuel volume measurement unit is equal to or larger than a third predetermined value that is smaller than the first predetermined value and the detected value by the pressure sensor is smaller than the second predetermined value, the control unit performs a preliminary valve-closing control to adjust a valve opening degree of the electrically-operated valve to 10% to 50%.

10. The evaporated fuel treatment apparatus according to claim 6, wherein before the electrically-operated valve is closed, when the measured value by the fuel volume measurement unit is equal to or larger than a third predetermined value that is smaller than the first predetermined value and the detected value by the pressure sensor is smaller than the second predetermined value, the control unit performs a preliminary valve-closing control to adjust a valve opening degree of the electrically-operated valve to 10% to 50%.

* * * * *